US005429019A

United States Patent [19]

Davey

[11] Patent Number: 5,429,019

[45] Date of Patent: Jul. 4, 1995

[54] PLUG MANIPULATOR TOOL FOR SWIMMING POOL SKIMMER

[76] Inventor: Wayne C. Davey, 4493 Rainbow Vista Dr., Fallbrook, Calif. 92028

[21] Appl. No.: 87,910

[22] Filed: Jul. 9, 1993

[51] Int. Cl.[6] ..... B25B 23/00

[52] U.S. Cl. ..... 81/460; 81/176.15

[58] Field of Search ..... 81/459, 460, 461, 176.1, 81/176.15, 176.2

[56] References Cited

U.S. PATENT DOCUMENTS

| | | | |
|---|---|---|---|
| 541,651 | 6/1895 | Baumgartner | 81/176.15 |
| 2,402,477 | 6/1946 | Williams | 81/176.15 |
| 4,149,434 | 4/1979 | Wilson | 81/461 |

*Primary Examiner*—D. S. Meislin
*Attorney, Agent, or Firm*—John T. Matlago

[57] ABSTRACT

A plug manipulator tool for closing off the suction outlet of a skimmer of a swimming pool comprises a threaded hollow plug body having a cap resiliently held on the top thereof. The cap is provided with an elongated handle on the top surface thereof which enables the threaded plug to be remotely engaged within the threaded opening of the suction outlet of the skimmer by an operator twisting the outer end of the elongated handle. In order for the operator to remotely remove the plug while the circulating pump for the swimming pool is running, the operator tilts the upper end of the elongated handle to thereby tilt the cap so that water in the skimmer can flow into the hollow plug body and down through the suction outlet thereby breaking the suction holding the cap on the top of the hollow plug body.

5 Claims, 4 Drawing Sheets

PLUG MANIPULATOR TOOL FOR SWIMMING POOL SKIMMER

This invention relates to tools useful when cleaning swimming pools with a portable vacuum pool cleaner and more particularly to a plug manipulator tool that enables a pool technician to remotely connect and disconnect a plug from the suction outlet of a skimmer of a swimming pool while the circulating pump is running.

BACKGROUND OF THE INVENTION

A swimming pool installation is often provided with two or more skimmers for filtering the water in the pool. The skimmers are operated by connecting suction outlets on the bottom thereof to the input of an external circulating pump located in an area adjacent the swimming pool. When a pool technician prepares to vacuum the floor of the swimming pool by use of a portable vacuum cleaner placed in the pool, he needs to make all of the vacuum produced by the circulating pump available to the portable vacuum cleaner. The pool technician does this while the circulating pump is running by extending his hand up to his elbow into the water of each of the skimmers, except one, to engage a threaded plug into the threaded suction outlet thereof. The pool technician, at this time, also closes a manually controlled valve in a pipe that connects the main drain suction outlet on the bottom of the pool to the inlet of the circulating pump during filtering of the water in the pool. In this way, all the vacuum produced by the pump is made available to the suction outlet of the one skimmer that is still connected to the circulating pump. The pool technician then inserts the end of a flexible hose on the portable vacuum cleaner down into the water of the one skimmer and connects it to the suction outlet thereof thereby making all the vacuum of the circulating pump available to operate the portable vacuum cleaner.

After cleaning the pool with the vacuum cleaner, in order for the skimmers to resume filtering of the water in the pool, the circulating pump has to be turned off to enable the pool technician to disconnect the plugs from the suction outlets of the skimmers by again extending his hand up to his elbow into the water of each of the skimmers. The reason for turning off the circulating pump at this time is because it is virtually impossible for the pool technician to remove a threaded plug from the threaded suction outlet of a skimmer while the circulating pump is running because of the pull of the vacuum on the plug. This need for the pool technician to have to extend his hand up to his elbow into the water of a skimmer when he connects and disconnects a plug in the suction outlet thereof creates a problem especially during the winter months when the water in the swimming pool is cold and the pool technician has to remove his shirt and/or jacket that covers his arms to prevent his clothing from getting wet.

SUMMARY OF THE INVENTION

A plug manipulator tool for a skimmer of a swimming pool according to the present invention includes a hollow plug body having radial cross bars with a central projecting portion extending down from the top surface of the hollow body plug into the interior thereof. A cap in the form of a disk is provided to cover the top of the hollow plug body. The cap has radial cross slots formed on the bottom surface thereof that extend down into the interior of the hollow plug body so as to freely engage the radial cross bars on the hollow plug body when the cap covers the top surface of the hollow plug body. A screw that has a coiled spring encircling the upper portion thereof beneath its head, has its lower portion freely passing through an enlarged hole in the center of the cap and engaged in a threaded hole provided on the central projecting portion in the interior of the hollow plug body. Rotating the head of the screw advances its threaded end into the threaded hole on the central projecting portion of the hollow plug body. This causes the head of the screw to bear down on the top end coil of the coiled spring to thereby cause the lower end coil of the coiled spring to bear down on the top surface of the cap and thereby resiliently hold the bottom surface of the cap against the top surface of the hollow plug body. An elongated handle is held in a central hub portion provided on the top surface of the cap. The elongated handle enables the threaded plug body to be remotely inserted into and removed from the threaded suction outlet of a skimmer by a pool technician without the need for him having to extend his hand up to his elbow in the water in the skimmer. Moreover, the threaded plug body on the plug manipulator tool can be removed from the suction outlet of a skimmer without the need for turning off the pump, by tilting the elongated handle of the plug manipulator tool such that a gap is formed between the edge of the bottom surface of the cap and the top surface of the hollow plug body. This enables water in the skimmer to flow into the interior of the hollow plug body and thereby break the vacuum of the pump that is holding the plug body within the suction outlet of the skimmer.

Accordingly, one of the objects of the present invention is to provide a plug manipulator tool which enables a pool technician to remotely engage a threaded plug in the threaded suction outlet of a skimmer of a swimming pool and disengage it therefrom without having to extend his hand up to his elbow into the water in the skimmer.

Another object of the present invention is to provide a plug manipulator tool which enables a pool technician to remotely remove a threaded plug from the threaded suction outlet of a skimmer of a swimming pool without the need for turning off the circulating pump.

These and other objects, features and advantages of the present invention will be made more readily apparent from the following detailed description of the preferred embodiment as illustrated in the following drawings.

DESCRIPTION OF THE PREFERRED EMBODIMENT

Figure 1:
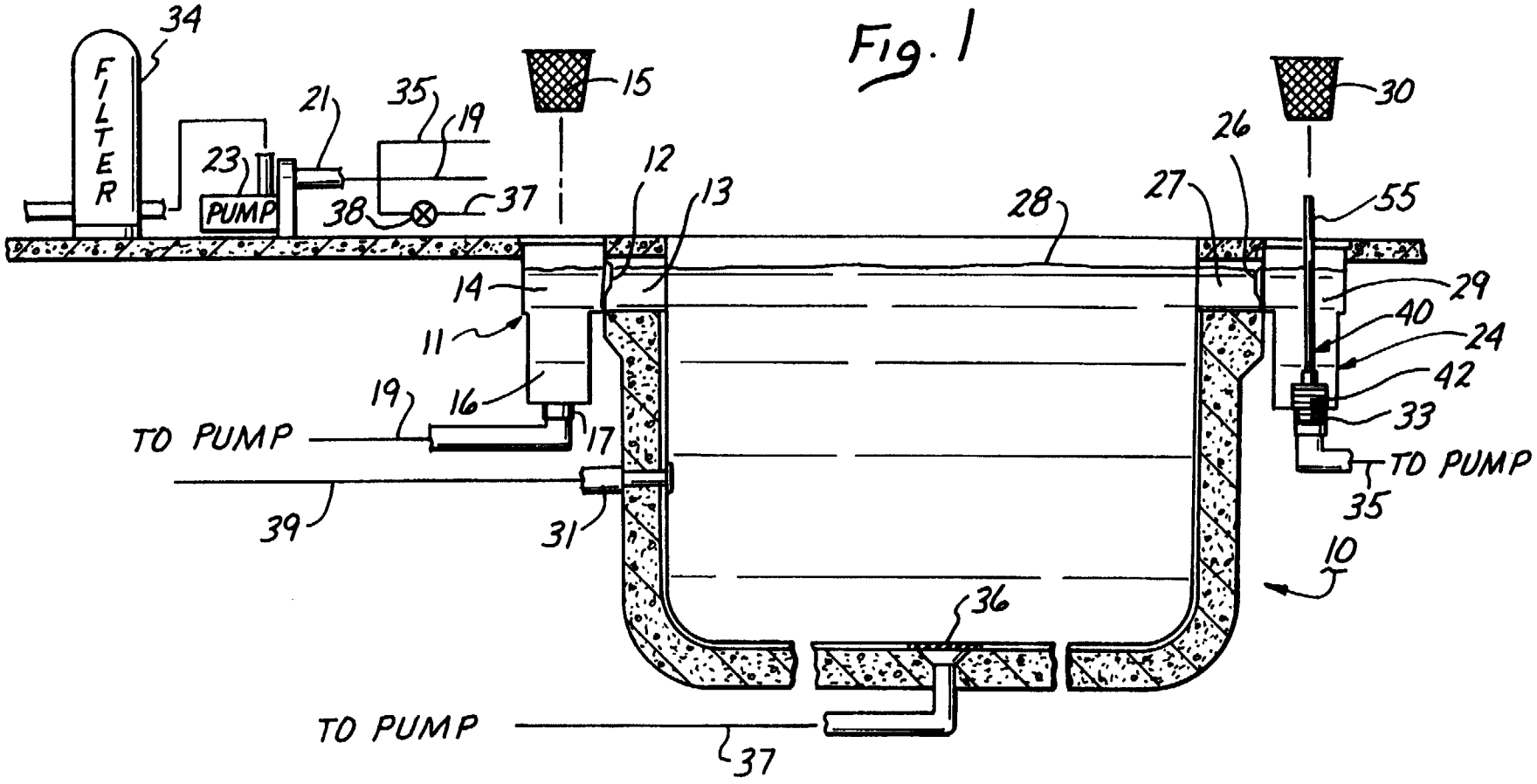
FIG. 1 illustrates a typical swimming pool installation showing the plug manipulator tool of the present invention mounted within the suction outlet of one of the two skimmers provided thereon.

Reference will first be made to FIG. 1 which illustrates a typical swimming pool installation 10 provided with a pair of skimmers 11 and 24 on the upper sidewalls thereof. Skimmer 11 is provided with a floating weir 12 at the inlet 13 to the upper chamber 14 thereof. A leaf basket 15 that is normally supported within the lower chamber 16 of the skimmer 11 is shown removed therefrom. A suction outlet 17 provided on the bottom of the lower chamber 16 is connected by a pipe 19 to the input 21 of an external circulating pump 23 located in an area adjacent the pool. Similarly, skimmer 24 is provided with a floating weir 26 at the inlet 27 into the upper chamber 29 thereof. A leaf basket 30 that is normally supported within the lower chamber 32 of skimmer 24 is shown removed therefrom. A suction outlet 33 provided on the bottom of the lower chamber 32 is connected by a pipe 35 to the input 21 of circulating pump 23. A plug manipulator tool 40 of the present invention is shown mounted within the suction outlet 33 of the skimmer 24. In addition, as shown in FIG. 1, a main drain suction outlet 36 on the bottom of the pool is connected by a pipe 37 having a manual valve 38 therein to the input 21 of the circulating pump 23. It should now be clearly understood that normally when the circulating pump 23 is running it applies suction to the suction outlets 17 and 33 of skimmers 11 and 24 which causes water from the top surface 28 of the pool to be drawn past the floating weirs at the inlets of these skimmers and down through the leaf baskets thereof so as to be discharged through the suction outlets thereof into the pipes that connect to the input 21 of the pump 23. Likewise, the suction of the circulating pump 23 applied to the suction outlet 36 of the main drain on the bottom of the pool causes water from the floor of the pool to be discharged through pipe 37 to the input of the pump 23. All this water is then passed through the filter 34 which removes any debris therein and returns the clean water back to the pool by a pipe 39 that connects to inlets 31 provided on the side wall of the skimmer, only one of which inlets is shown in FIG. 1.

Now when the pool technician is preparing to clean the swimming pool with a portable vacuum cleaner (not shown) placed on the floor of the swimming pool, he needs to make all of the vacuum that is produced by the circulating pump 23 available for this purpose. Thus, the pool technician places plug manipulator tool 40 of the present invention by use of its elongated handle 55 into the top of the skimmer 24 and down into the water therein such that it engages the suction outlet 33 provided at the bottom thereof. This cuts off the suction supplied by the pump 23 to the skimmer 24. It should be noted that if the swimming pool is provided with more than two skimmers, each of the additional skimmers, that is, all the skimmers but the skimmer 11 would be similarly provided with a plug manipulator tool 40 of the present invention engaged in the suction outlet thereof. Moreover, the pool technician manually closes the valve 38 provided in the pipe 37 so as to cut off the vacuum of the pump 23 that is being supplied to the suction outlet 36 of the bottom main drain of the swimming pool.

It should now be clearly understood that all of the suction provided by the pump 23 is now made available at the suction outlet 17 of skimmer 11. Thus, after placing the portable vacuum cleaner (not shown) on the floor of the pool, the pool technician inserts the end of the flexible hose of the cleaner through the inlet 13 of the skimmer 11 and then down through the water in the skimmer so that it connects to the suction outlet 17 thereof. A type of tool for enabling this to be done without the need for the pool technician to extend his hand up to his elbow into the water in the skimmer is described in my copending application, Ser. No. 087,670 filed Jul. 9, 1993.

Figure 2:
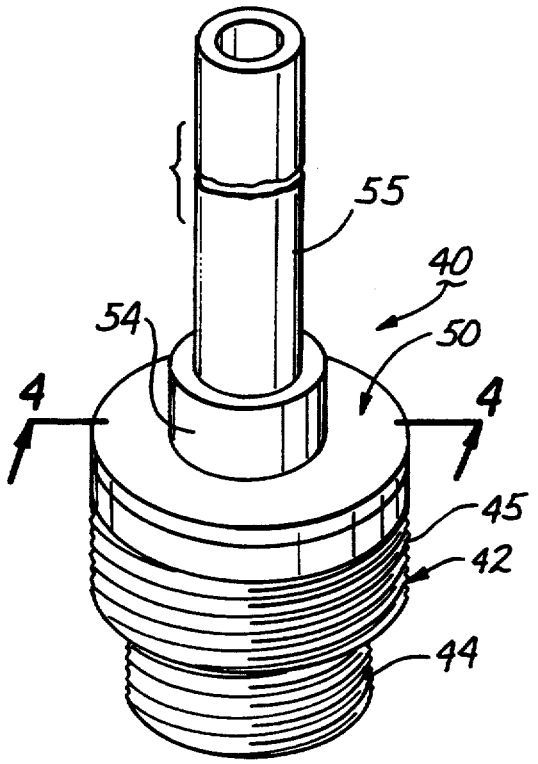
FIG. 2 is a perspective view of the plug manipulator tool of the present invention.

Reference will next be made to FIG. 2 which shows a perspective view of the plug manipulator tool 40 of the present invention that is mounted within the suction outlet 33 of skimmer 24 in FIG. 1. As best shown in FIG. 4, the plug body 42 of the plug manipulator tool 40 is provided on the lower portion outer surface thereof with a 1½" O.D. pipe thread 44 which steps up to a 2" O.D. pipe thread 45 on the upper portion outer surface thereof. These two threaded portions are provided on the outer surface of the hollow plug body 42 because the threaded suction outlets of skimmer used on swimming pools can be made with either of these size threads. A cap 50 for the hollow plug body 42 has an outer circumferential surface which conforms with that of the upper portion of the hollow plug body 42. The bottom flat surface 52 of cap 50 (FIG. 3) is positioned to lie against the top flat surface 53 of the hollow plug body 42. An elongated tubular handle 55 has its lower end portion-seated and secured (FIG. 4) within the opening 56 of a hub portion 54 formed on the top of the cap 50. The hollow plug body 42, the cap 50, and the elongated tubular handle 55 can be made of plastic material.

Figure 3:
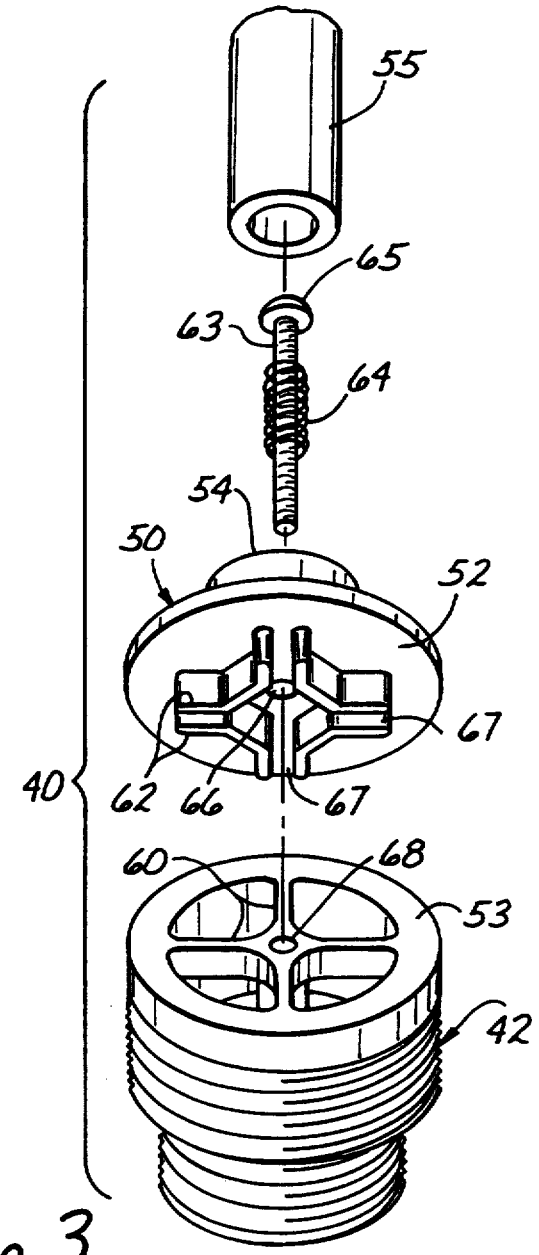
FIG. 3 is an exploded view showing the parts forming the plug manipulator tool.
Figure 4:
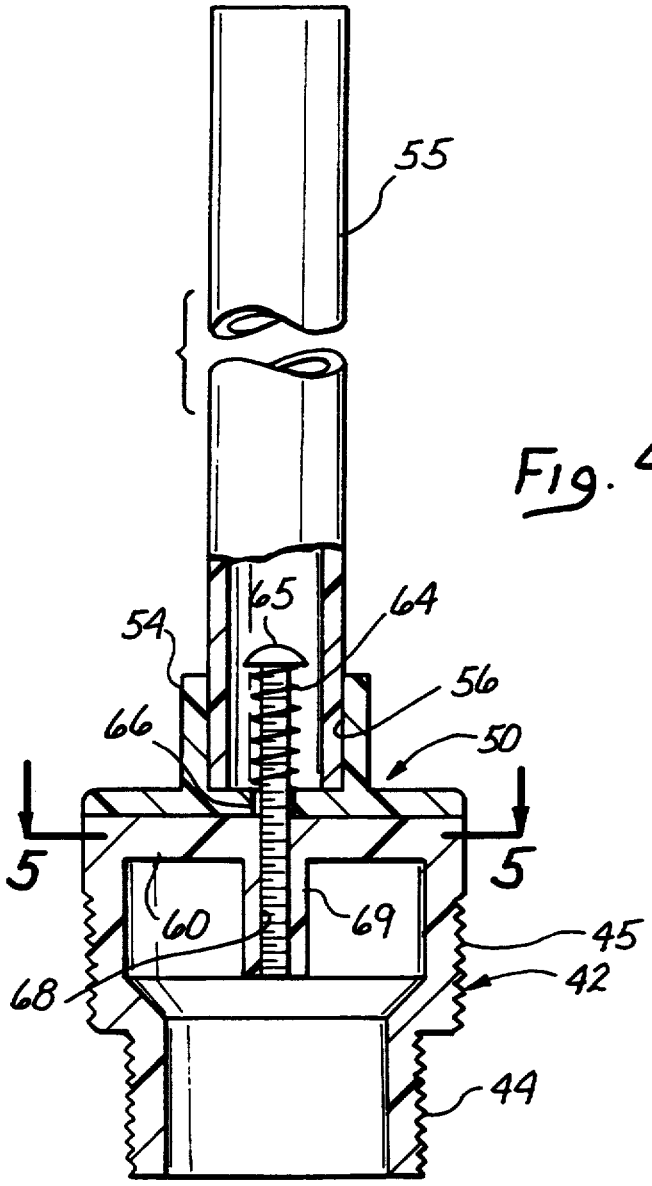
FIG. 4 is a sectional view of the plug manipulator tool in FIG. 2.

Reference will next be made to FIG. 3 which is an exploded perspective view of the parts comprising the plug manipulator tool 40. As noted in FIG. 3, the flat top surface 53 of the hollow plug body 42, which is provided with a generally circular internal opening therethrough, includes the flat top surface of the radial cross bars 60 that axially extend down from the top surface 53 into the interior therof. The radial cross bars are oriented along diameters that are at 90° with respect to each other. The flat bottom surface 52 of the cap 50 for the hollow plug body 42 is formed with axially extending opposing sidewalls 62 that are located inwardly from the outer circumference thereof. When the cap 50 is positioned on the top of the hollow plug body 42, the pairs of opposing sidewalls 62 that extend down into the interior of the hollow plug body 42 are spaced to form radial cross slots 67 thereon that are oriented along diameters that are 90° with respect to each other to thereby freely engage with the radial cross bars 60 that extend down from the top surface of the hollow plug body 42 into the interior thereof. A screw 63, provided with a coiled spring 64 along the length thereof, has its end portion freely extending through an enlarged hole 66 provided on the center of the cap 50. FIG. 4, which is a partially sectional view of the plug manipulator tool 40 shown in FIG. 2, shows that the threaded end of the screw 63 engages in a threaded hole 68 provided on a central axially projecting portion 69 depending from the central portion of the radial cross bars 60 formed within the hollow plug body 42.

Figure 5:
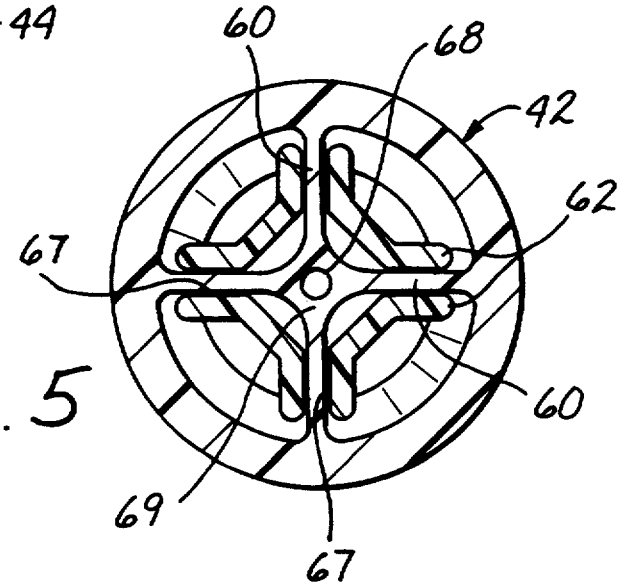
FIG. 5 is a sectional plan view taken along line 5—5 of FIG. 4 showing the radial cross slots on the bottom surface of the cap freely fitted over the radial cross bars extending down from the top surface of the hollow plug body.

Note that when the head 65 of screw 63 is rotated to advance the screw 63 into the central threaded hole 68 on the central projecting portion 69 within the hollow plug body 42, the head 65 axially compresses the coiled spring 64 such that its lower end coil bears down on the top surface of the cap 50 that surrounds the central hole 66 on the cap. Thus, the flat bottom surface 52 of cap 50 is resiliently held down against the flat top surface 53 of the hollow plug body 42 thereby sealing off the hollow interior of the latter from the water in the skimmer 24 when the threaded hollow plug body 42 is engaged into the threaded suction outlet 33 of the skimmer 24. As seen in FIGS. 3 and 5, when the bottom surface 52 of cap 50 is positioned and held by the compressed coiled spring 64 against the top surface 53 of the hollow plug body 42, the opposing sidewalls 62 that form the radial cross slots 67 on the bottom surface 52 of the cap 50 straddle the radial cross bars 60 provided on the top portion of the hollow plug body 42.

Figure 6:
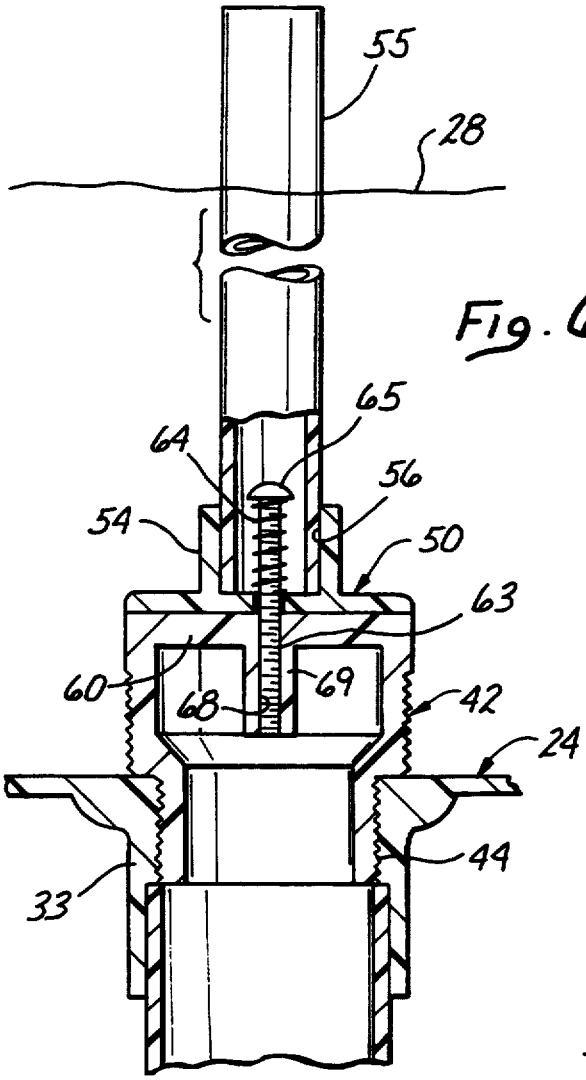
FIG. 6 is a sectional view of the plug manipulator tool in FIG. 4 mounted within the suction outlet of a skimmer.

It should now be clearly understood that when the plug manipulator tool 40 of the present invention is positioned above the suction outlet 33 of the skimmer 24 by the pool technician holding onto the upper end portion of the tubular handle 55, the opposing sidewalls 62 of the radial cross slots 67 on the bottom surface 52 of the cap 50 freely straddle the radial cross bars 60 within the top internal portion of the hollow plug body 42. Thus, it is this coupling between the cap 50 and the hollow plug body 42 that enables the pool technician to twist the upper end of the handle 55 to rotate the plug body 42 so that the threads on the outer surface thereof engage the internal threads formed on the suction outlet 33 of the skimmer 24. As shown in FIG. 6, the plug manipulator tool 40 is left in the suction outlet 33 of the skimmer 24 while the pool is being vacuumed by the pool technician using a portable vacuum pool cleaner.

Figure 7:
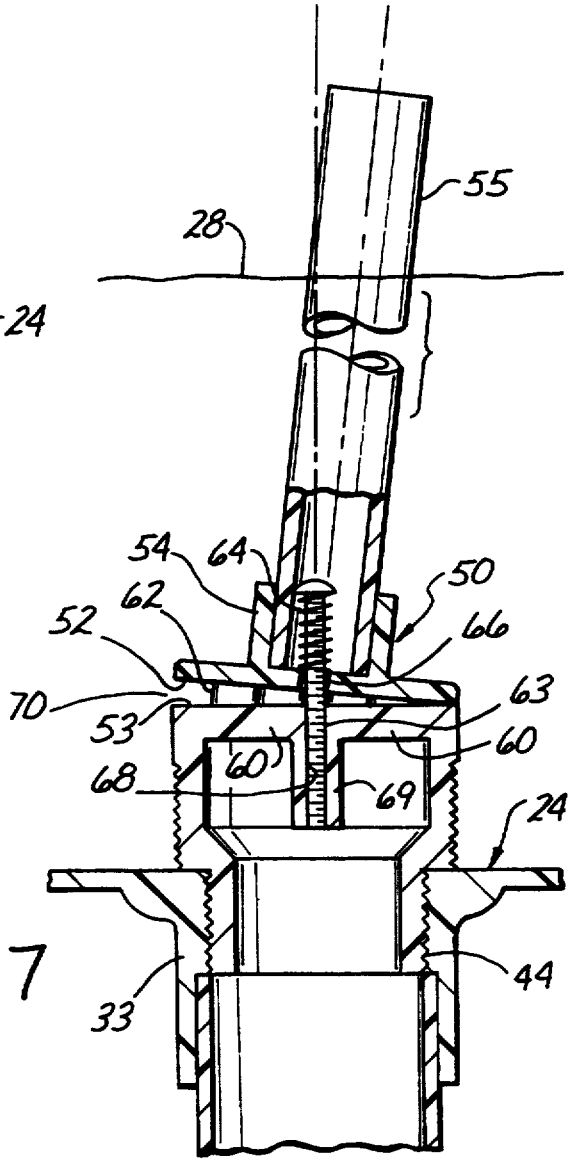
FIG. 7 is a sectional view of the plug manipulator tool in FIG. 4 mounted within the suction outlet of a skimmer with the elongated handle on the cap tilted to provide a gap between the end of the bottom surface of the cap and the top surface of the hollow plug body.

After the pool is cleaned, in order to return the pool installation back to its water filtering operation wherein the suction outlet 33 of the skimmer 24 receives the vacuum supplied by the circulating pump 23, it is necessary to remove the plug body 42 of the plug manipulator tool 40 from the suction outlet 33 of the skimmer 24. However, it is virtually impossible to remove the hollow plug body 42 with the cap 50 on the top surface thereof from the suction outlet 33 of skimmer 24 by just twisting the handle 55 because of the downward pull of the suction present on the hollow plug body 42 when the pump 23 is running. Thus, in order to remove the plug manipulator tool 40 of the present invention without turning off the circulating pump 23, the pool technician needs only to tilt the handle 55 by grasping the upper end portion thereof that extends up out of the top opening in the skimmer 24. As shown in FIG. 7, the compressed coiled spring 64 that encircles the upper portion of the screw 63 and holds the bottom surface of the cap 50 against the top surface of the plug body 42 permits the cap 50 to be tilted when the handle 55 is tilted to provide a gap 70 between the bottom edge surface 52 of the cap 50 and the top edge surface 53 of the hollow plug body 42. This permits water in skimmer 24 to flow through the gap into the internal opening in the hollow plug body 42 and out the suction outlet 33 thereof. This action serves to break the vacuum at the suction outlet 33 so that the hollow plug body 42 can now be rotated by the pool technician twisting the outer end portion of the handle 55 while it is in its tilted position, thereby enabling the plug body 42 to be removed from the suction outlet 33 of the skimmer 24 while the pump 23 is running. It should be especially noted that the radial cross bars 60 on the top portion of the hollow plug body 42 and the radial cross slots 67 on the bottom of the cap 50 are made sufficiently long enough axially so that even when the handle 55 is tilted about a diameter normal to radial cross bars 60 engaged within radial cross slots 67 they remain interlocked with each other. Moreover, the spacing of the opposing sidewalls 62 that formed slots 67 along the diameter that is normal to the direction of the tilt of the handle 55 has to be large enough to enable the radial cross bars 60 along that diameter to tilt transversely within the radial slots 67 oriented along that diameter.

It should be further noted that as a result of the plug manipulator tool 40 of the present invention having an elongated handle 55 attached to the cap 50 for the threaded plug body 42 on the lower end thereof, the threaded plug body 42 can be mounted within the threaded suction outlet 33 of the skimmer 24 and withdrawn therefrom by the service man twisting the upper end of the handle 55 which extends above the surface of the water in the skimmer. As previously discussed, in the prior art, it is a nuisance and uncomfortable for the service man to have to remove his shirt and/or jacket, especially during the winter months when the water in the pool is cold, to assure that these clothings do not get wet when he extends his hand up to his elbow in the skimmer to insert and withdraw a threaded plug from the threaded suction outlet of a skimmer.

While the invention which has been described herein has been adapted to fulfill the objects and advantages previously enumerated as desirable, it is to be understood that the invention is not to be limited to the specific features shown and described but that the means and configuration herein disclosed are susceptible of modification in form, proportion and arrangement of parts without departing from the principle involved or sacrificing any of its advantages, and the invention is therefore claimed in embodiments of various forms all coming within the scope of the claims which follow.

What is claimed is:

1. A plug manipulator tool comprising:

a plug body having a hollow interior;

said plug body having a top surface which includes a depending axial projection with radial bars disposed at the top of the hollow interior thereof;

a cap covering the top surface of said plug body;

said cap having a bottom surface with opposing tabs depending therefrom that freely engage the radial bars on the top surface of the hollow interior of said plug body;

a screw having a head, an upper portion and a lower end portion;

a coiled spring freely encircling the upper portion of said screw;

said screw having the lower end portion thereof freely passing through an axial opening in the cap and engaged in a threaded hole on the axial projection of the hollow plug body;

whereby said coiled spring is compressed between the head of the screw and the top surface of said cap that surrounds the axial opening therein to resiliently hold the bottom surface of the cap against the top surface of the hollow plug body; and an elongated handle having its lower end attached to the top of said cap.

2. A plug manipulator tool as defined in claim 1 wherein the outer surface of said plug body is threaded.

3. A plug manipulator tool as defined in claim 1 wherein said elongated handle is formed with a tubular bottom end portion; and said cap is formed with a hollow hub on the top thereof whereby when the tubular bottom end portion of said handle is held in the hollow hub of the cap it encloses the upper portion of the screw which is encircled by the coiled spring.

4. A plug manipulator tool which provides for engaging a threaded plug on the bottom end thereof into the threaded suction outlet on the bottom of a skimmer filled with water during the course of cleaning a swimming pool floor with a portable vacuum cleaner, said plug manipulator tool comprising:

a threaded plug body having a hollow interior;

said plug body having an axial projecting portion extending down into the hollow interior thereof and radial cross bars extending across the top of the hollow interior thereof;

a cap having a bottom surface provided with radial cross slots formed thereon by opposing sidewalls that depend down into the interior of said plug body so as to freely engage the radial cross bars on the plug body when said cap covers the top surface of said plug body;

a screw having a head, an upper portion and a lower end portion;

a coiled spring freely encircling the upper portion of said screw;

said screw having its lower end portion freely passing through an axial hole in said cap and engaged in a threaded hole on the axial projecting portion of said plug body;

whereby rotating the head of the screw advances its lower end into the axial threaded hole provided on the axial projecting portion of said plug body and compresses said coiled spring to resiliently hold the bottom surface of the cap against the top surface of the plug body; and an elongated handle having its lower end attached to the top of said cap;

whereby said threaded plug body can be remotely engaged and disengaged into and out of the threaded suction outlet of the skimmer by a pool technician holding onto the upper end of the elongated handle which extends out of the upper surface of the water in the skimmer.

5. A plug manipulator tool for use in closing off and opening up a threaded suction outlet provided on the bottom of a skimmer filled with water so that the vacuum of a circulating pump being supplied to the threaded suction outlet of the skimmer can in the interim be made available to a portable vacuum cleaner being used for cleaning the floor of the swimming pool, said manipulator tool comprising:

a threaded plug body having a hollow interior;

said plug body having an axial projecting portion extending down into the hollow interior thereof and radial cross bars extending across the top of the hollow interior thereof;

a cap having a bottom surface provided with opposing sidewalls defining radial cross slots that depend down into the interior of said plug body and freely engage the radial cross bars thereon when said cap covers the top surface of said plug body;

a screw having a head, an upper portion and a lower end portion;

a coiled spring freely encircling the upper portion of said screw;

said screw having the lower end portion thereof freely passing through an axial opening in the cap and engaged in a threaded hole on the axial projecting portion in the hollow interior of said plug body; and an elongated handle having its lower end attached to the top of said cap;

whereby after the floor of the swimming pool has been cleaned by the portable vacuum cleaner and it is desired to disconnect the plug manipulator tool to open the threaded suction outlet of the skimmer while the circulating pump is running, the elongated handle which extends above the water in the skimmer can be tilted by a pool technician thereby tilting the cap to provide a gap between the edge of the bottom surface of the cap and the top surface of the plug body which enables the water in the skimmer to be drawn into the hollow interior of the plug body and break the vacuum of the circulating pump; and whereby the elongated handle can be twisted while in its tilted position to disengage the threaded plug body from the threaded suction outlet of the skimmer.

* * * * *